United States Patent [19]

Nonnemacher et al.

[11] 4,074,955

[45] Feb. 21, 1978

[54] PUMPING ARRANGEMENT CONTROL DEVICE

[75] Inventors: Gerhard Nonnemacher, Korntal; Emil Knodel, Stuttgart; Walter Robeller, Boblingen; Paul Bosch, Ludwigsburg, all of Germany

[73] Assignee: Robert Bosch GmbH, Stuttgart, Germany

[21] Appl. No.: 656,582

[22] Filed: Feb. 9, 1976

[30] Foreign Application Priority Data

Feb. 12, 1975 Germany ..... 2505779

[51] Int. Cl.[2] ..... F04B 49/00; F04B 1/26; F16B 31/02

[52] U.S. Cl. ..... 417/218; 60/448; 60/488

[58] Field of Search ..... 417/216, 218, 221, 222, 417/280, 46; 60/431, 445, 448, 449, 452, 488

[56] References Cited

U.S. PATENT DOCUMENTS

| | | | |
|---|---|---|---|
| 3,214,911 | 11/1965 | Kempson | 60/450 |
| 3,932,993 | 1/1976 | Riedhammer | 60/449 |
| 3,937,597 | 2/1976 | Bacquie et al. | 417/15 |
| 3,969,896 | 7/1976 | Louis | 60/452 |
| 3,986,357 | 10/1976 | Hoffman | 60/444 |

*Primary Examiner*—William L. Freeh

*Attorney, Agent, or Firm*—Michael J. Striker

[57] ABSTRACT

An arrangement for pumping fluids includes at least one variable-output pump and a drive therefor. An auxiliary pump is also driven by the drive and discharges control fluid at a rate corresponding to the speed of rotation of the drive into a discharge conduit in which a variable flow-through cross-sectional area throttle valve is located. The pressure in the discharge conduit upstream of the throttle valve controls the displacement of a control slide between the two end positions thereof in one of which the control slide controls the variable-output pump so as to increase the output thereof, while in the other of such positions of the control slide the pump is controlled so as to reduce the output thereof. The throttle valve is responsive to the pressure in the discharge conduit, but can be arrested in any position thereof when the drive is overloaded so that the flow-through cross-sectional area thereof is fixed, which results in a decrease of output of the variable-output pump when the drive is overloaded. Advantageously, the throttle valve is arrested when the power input to the drive exceeds a predetermined value. The arresting of the throttle valve may be effected by using an actuating electromagnet which is energized in response to overloading conditions of the drive by a switch interposed in the electric circuit of the electromagnet and controlled by the drive.

20 Claims, 6 Drawing Figures

PUMPING ARRANGEMENT CONTROL DEVICE

BACKGROUND OF THE INVENTION

The present invention relates to a pumping arrangement in general, and more particularly to an arrangement for pumping fluids which is equipped with a control arrangement which is so constructed as to prevent overloading of the drive of the pumping arrangement.

There are already known various pumping arrangements of the type here under consideration, and usually such arrangements include one or more pumps which is or are driven by a drive, such as an internal combustion engine. It is also known, in such pumping arrangements, to provide an auxiliary pump which discharges control fluid at a rate corresponding to the speed of the drive, a throttle or flow restrictor being provided in the discharge conduit of the auxiliary pump. It is known from these arrangements that, when the throttle or flow restrictor is of a fixed flow-through cross-sectional area, the pressure in the discharge conduit upstream of the throttle will vary proportionately to the square of the speed of rotation of the auxiliary pump which, in turn, is at a fixed ratio to the speed of rotation of the drive. Thus, the pressure in the discharge conduit upsteam of the throttle will give an indication of the speed of rotation of the drive. It is already known from the prior art to utilize the pressurized fluid in the discharge conduit of the auxiliary pump for displacing a control slide or a similar valve between two positions of the same, the control slide being interposed into the control circuit of the respective pump so as to control flow of fluid therethrough in such a manner that, when the pressure in the discharge conduit of the auxiliary pump exceeds a predetermined level, the variable-output pump is adjusted toward higher output, and conversely when the pressure in the discharge conduit drops below a predetermined value.

In such conventional control arrangements for controlling the output of a variable-output pump, the flow-through cross-sectional area of the throttle, which determines the pressure with which the control fluid in the discharge conduit of the auxiliary pump acts on the control slide, and a force exerted on the control slide by a spring which urges the control slide against the action of the pressurized fluid, are so selected relative to one another that, when the speed of rotation of the drive decreases by a certain amount with respect to a predetermined operating value, the force of the spring overcomes the force exerted by the pressurized fluid in the discharge conduit, and the control slide is displaced into a position in which the output of the variable-output pump is decreased. One of the main disadvantages of these prior-art constructions is that the control arrangement is only responsive to the speed of rotation of the drive, and does not depend at all on other operating conditions thereof, such as the power input to the drive, which may result in a situation where the drive may be overloaded during some phases of operation of the pumping arrangement, while it may operate under less than optimum utilization conditions during other phases of operation of the pumping arrangement.

SUMMARY OF THE INVENTION

Accordingly, it is a general object of the present invention to overcome the disadvantages of the prior art pumping arrangements.

More particularly, it is an object of the present invention to provide a pumping arrangement which, as a whole, operates under optimum conditions.

It is a further object of the present invention to provide a control arrangement which so controls the pumping arrangement as to allow the drive of the pumping arrangement to operate at optimum utilization thereof.

It is still another object of the present invention to provide a control arrangement of the above-mentioned type which is simple in construction and reliable in operation.

A concomitant object of the present invention is to provide a control arrangement for controlling a variable-output pump or a plurality of such pumps which so controls the pump or pumps as to avoid overloading of the drive, while permitting the drive to operate under optimum conditions.

A further object of the present invention is to provide a control arrangement which reduces the output of the pumping arrangement when the power input to the drive exceeds a predetermined value.

In pursuance of these objects and others which will become apparent hereafter, one feature of the present invention resides, briefly stated, in an arrangement for pumping fluids which comprises, in combination, pumping means for pumping a fluid at a variable output rate, adjusting means for adjusting the output rate of the pumping means, driving means for driving the pumping means at varying speeds, first generating means for generating a first signal indicative of power input to the driving means, second generating means for generating a second signal proportionate to the speed of the driving means, and control means for controlling the adjusting means in dependence on the first and second signals, including varying means for changing the proportionality characteristic of the second generating means when the first signal reaches a predetermined value.

In a currently preferred embodiment of the present invention, the pumping means includes at least one variable-output pump which has an adjusting element adapted to control the output rate of the pump. The adjusting means includes displacing means for displacing the adjusting element between low-output and high-output positions thereof, and the control means further includes a control slide which is displaceable between a first position in which the displacing means displaces the adjusting element toward the low-output position and a second position in which the displacing means displaces the adjusting element toward the high-output position, the control slide being responsive to the changes in the second signal. The pumping arrangement may further include an auxiliary pump which is also driven by the driving means and operative for discharging control fluid at a rate proportionate to the speed of the driving means so as to generate the second signal, a discharge conduit communicating with the auxiliary pump, and a throttle valve in the discharge conduit which has a valve housing and a valve member mounted in the valve housing for displacement between an extended and a retracted position through a plurality of intermediate positions in which the throttle valve has different flow-through cross-sectional areas for passage of the control fluid therethrough, biasing means urging the valve member toward the extended position thereof, and means for admitting the control fluid in the discharge conduit upstream of the throttle valve to the latter to act on the valve member against action of the biasing means. The varying means preferably includes arresting means for arresting the valve member in any of the positions thereof when the first signal reaches the predetermined value thereof to thereby maintain the respective flow-through cross-sectional area of the throttle valve. Thus, so long as the drive operates under no-overload conditions, the flow-through cross-sectional area of the throttle valve will increase correspondingly to the increase of the discharge rate of the auxiliary pump which, in turn, is proportionate to the speed of rotation of the driving means, while the approaching of the overload condition results in the generation of the first signal so that the throttle valve member is arrested and the throttle valve has a fixed flow-through cross-sectional area hereafter, so that a decrease in the speed of rotation of the auxiliary pump results in a drop in the pressure of the control fluid in the discharge conduit and thus in a decrease in the force which the fluid exerts on the control slide, whereby the biasing means displaces the control slide toward the first position thereof so that the output of the pumping means is reduced, thus replacing the demand for power from the drive or driving means so that overloading of the latter is prevented.

In this manner, it is possible to detect the actual load conditions of the driving means regardless of the speed of rotation thereof, and thus to fully utilize the available output torque, or power output, of the driving means, without running the danger of overloading the driving means. A particular advantage of the present invention is to be seen in the fact that it is possible to prevent overloading of the driving means while optimally utilizing the power output thereof not only for one rated speed of the driving means, but rather for speeds of the driving means within a broad range of such speeds.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
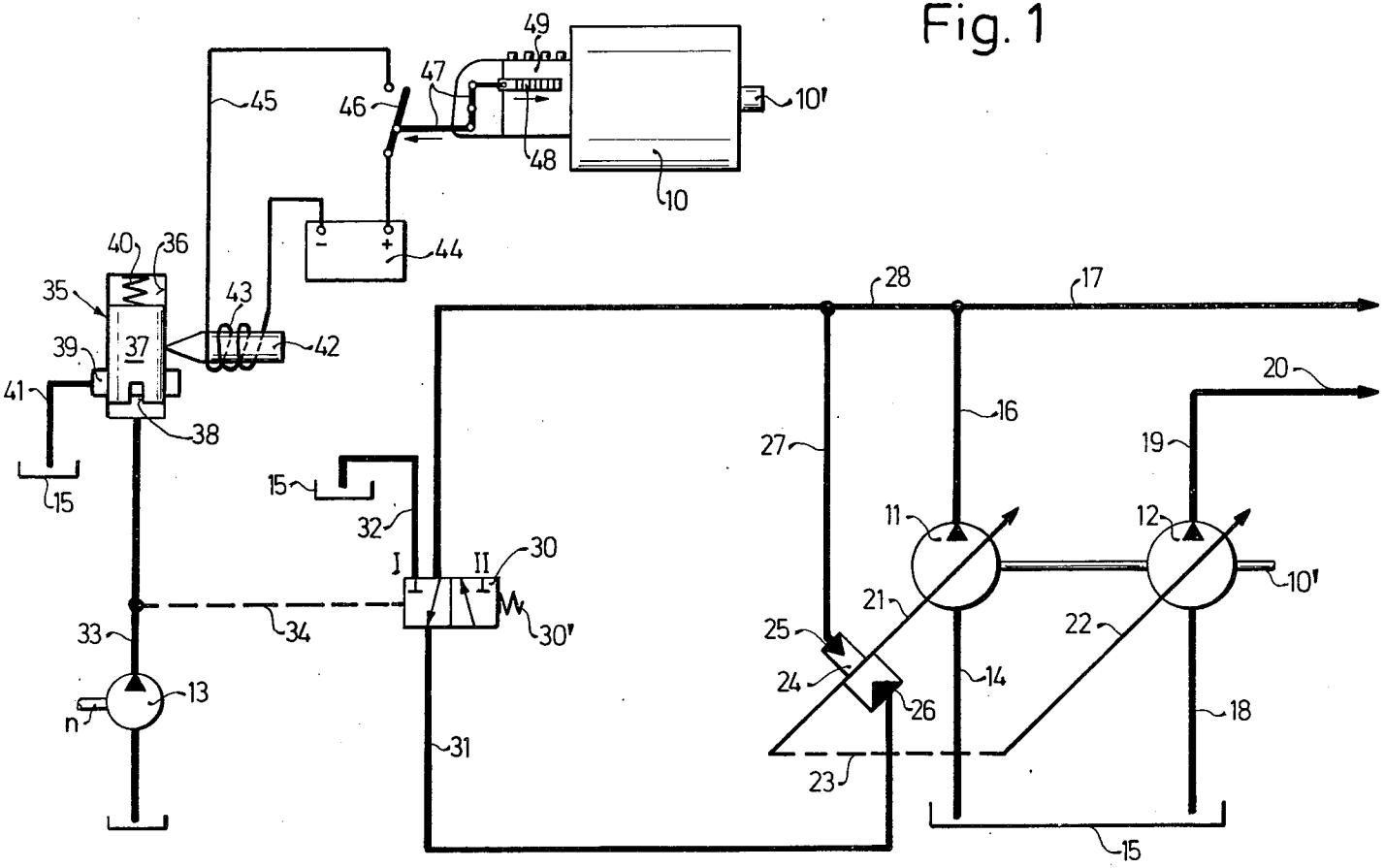
FIG. 1 is a diagrammatic representation of a control system for a pair of variable-output pumps in accordance with the present invention.

Referring now to the drawings, and first to FIG. 1, it may be seen that the reference numeral 10 designates a drive, such as a diesel engine, which has an output shaft 10′ which rotates at *n* revolutions per minute, depending on the operating conditions of the drive 10 and on the load to which the shaft 10′ is subjected. The output shaft 10′ drives a pair of variable-output pumps 11 and 12, and also an auxiliary pump 13. Thus, the speed of rotation of the pumps 11, 12 and 13 will be proportionate to the speed of rotation of the drive 10.

The variable-output pump 11 draws fluid, through a conduit 14, from a receptacle 15, and pumps the fluid through a conduit 16 into a first user circuit 17. Similarly, the variable-output pump 12 draws fluid from the receptacle 15 through a conduit 18, and pumps the fluid through a conduit 19 into a second user circuit 20.

The pump 11 has an adjusting element 21 by means of which the output rate of the variable-output pump 11 can be controlled. The variable-output pump 12 includes a similar adjusting elenent 22 which is mechanically coupled with the adjusting element 21 of the pump 11 by means of a connecting link 23.

The position of the adjusting element 21, and thus the output rate of the variable-output pump 11, is adjusted by means of a power amplifier or servomotor 24 which includes two pressure-actuated pistons 25 and 26. The piston 25 has a smaller active area than the piston 26 so that, when a pressurized medium at the same pressure is admitted to both pistons, the force exerted on the adjusting element 21 by the piston 26 exceeds that exerted upon the adjusting element 21 by the piston 25, whereas admission of the pressurized fluid only to the piston 25 results in a single force acting on the adjusting element 21. A conduit 27 and a connecting conduit 28 communicate the piston 25 with the first user circuit 17. It will be appreciated that, when the adjusting element 21 changes its position due to an excess force exerted by one of the pistons 25, 26 thereon, the mechanical coupling 23 between the adjusting elements 21 and 22 results in a commensurate change in the position of the adjusting element 22.

The connecting conduit 28 communicates the first user circuit 17 with a control slide 39 which is capable of assuming two positions designated with reference numerals I and II. A conduit 31 communicates the control slide 30 with the piston 26 of the power amplifier 24, and a conduit 32 communicates the control slide 30 with the receptacle 15.

A spring 30′ urges the control slide 30 toward the position II thereof. The auxiliary pump 13, which is driven by the output shaft 10′ of the drive 10, discharges control fluid into a discharge conduit 33, the pressure of the fluid in the discharge conduit 33 being proportionate to the speed of rotation of the output shaft 10′ of the drive 10 as will be explained later on. A conduit 34 communicates the discharge conduit 33 with the control slide 30 so that the pressurized control fluid in the discharge conduit 33 acts on the control slide 30 contrary to the force exerted on the control slide 30 by the biasing spring 30′ so that, when the force of the spring 30′ is overcome, the control slide 30 moves into the position I. The discharge conduit 33 further communicates with a throttle valve or flow restrictor which is designated in general with the reference numeral 35.

The throttle valve 35 has a bore 36 in which a valve member 37 is sealingly received for reciprocation between an extended position and a retracted position through a plurality of intermediate positions. The side of the valve member 37 which is acted upon by the control fluid in the discharge conduit 33 is formed with a throttling depression 38, and an annular recess surrounds the valve member 37 in the region of the throttling depression 38. A spring 40 acts on the valve member 37, urging the same toward its extended position against the force exerted upon the valve member 37 by the fluid discharged by the auxiliary pump 13 when the latter is in operation. A conduit 41 communicates the annular recess 39 with the receptacle 15. When the discharge rate of the auxiliary pump 13 increases, the pressure exerted by the control fluid on the valve member 37 displaces the latter against the force of the spring 40, thereby increasing the region of communication of the throttling depression 38 with the annular recess 39 so that an increased amount of control fluid will be able to pass through the throttle valve 35 as the discharge rate of the auxiliary pump 13 increases, without substantial increase in the resistance to flow of the control fluid through the throttle valve 35, and thus without substantial increase in the pressure of the control fluid in the discharge conduit 33. On the other hand, the throttling valve 35 presents sufficient resistance to the flow of the control fluid therethrough to increase the pressure in the discharge conduit 33, after an initial start-up period of operation of the drive 10, for displacing the control slide 30 into its position I. Once this normal operating pressure is achieved, the further increase in the discharge rate of the auxiliary pump 13 will result only in an insignificant increase in such pressure, due to the increase in the flow-through cross-sectional area of the throttling valve 35.

In this embodiment, there is provided an arresting member 42 which extends substantially normal to the path of movement of the valve member 37 between the extended and the retracted positions thereof, the arresting member 42 being operative for arresting the valve member 37 in any of the positions thereof. As illustrated, the arresting member 42 is constructed as an electromagnetically displaceable core of an electromagnet which further includes a coil 43 to which current may be supplied from a battery 44. A circuit 45 which connects the battery 44 with the coil 43 has a switch 46 interposed therein so that, when the switch 46 is closed, current from the battery 44 will flow to and through the coil 43, generating a magnetic field which displaces the arresting member 42 into arresting contact with the valve member 37. Thus, the valve member 37 is arrested in any position which it may assume at the instant when the switch 46 closes the electric circuit 45. A linkage 47 connects the switch 46 with a control rod 48 of an injection-control arrangement 49 of the diesel engine 10. The injection-control arrangement 49 is of a conventional construction so that it is not necessary to describe the same in any detail. Suffice it to say that the position of the control rod 48 of the injection-control arrangement 49 is indicative of the amount of fuel injected into the diesel engine 10. However, it is also possible to use a different device for displacing the switch 46 between the closed and open position thereof, so long as such device is responsive to the operating conditions of the drive 10 and capable of converting such operating conditions of the drive 10 into displacement of the switch 46. The operating conditions which may be used to control the movement of the switch 46 may also be, in addition to the position of the control rod 48 of the injection-control arrangement 49, arrangements for detecting the position of intake manifold throttle valve, the intake manifold pressure, or the exhaust gas temperature when the drive 10 is an internal combustion engine, or the current or electric power input when the drive 10 is an electromotor. Such other arrangements are also entirely conventional and need no detailed discussion herein. What matters for the present invention is that the switch 46 be closed as the operating conditions of the drive 10 approach their maximum permissible values.

The variable-output pumps 11 and 12 are driven into rotation by the drive 10, so that they draw fluid from the receptacle 15 and deliver the fluid into the respective first and second user circuits 17 and 20. The pressure in the first user circuit 17 is permanently applied, through the conduits 28 and 27, to the piston 25, and also to the piston 26 when the control slide 30 is in the position I, via the conduit 31. In this latter event, since the pressure of the medium acting on the pistons 25 and 26 is the same, the force of the piston 26 exceeds that of the piston 24 and the adjusting elements 21 and 22 are displaced toward a high-output position of the respective pump 11 or 12.

The auxiliary pump 13 discharges control fluid into the discharge conduit 33, the control fluid then acting on the valve member 37 of the throttling valve 35. As already explained above, the valve member 37 is displaced against the force exerted upon the same by the spring 40, which increases the flow-through cross-sectional area of the throttle valve 35 by increasing the region of comminucation of the throttling depression 38 with the annular recess 39. Thus, the throttling valve 35 initially has a substantially constant-pressure characteristic response for a relatively wide range of speeds of rotation of the output shaft 10' of the drive 10. The pressurized medium at this substantially constant pressure acts, via the conduit 34, on the control slide 30, so that the latter is displaced into its position I. This results in displacement of the adjusting elements 21 and 22 toward their positions in which the variable-output pumps 11 and 12 pump at their highest rates.

When the load on the drive 10 increases, due to the increasing demand which the pumps 11 and 12 place upon the drive 10, the control rod 48 of the injection-control arrangement 49 moves in the direction of the arrow, so that increased amounts of fuel are injected into the cylinders of the internal combustion engine 10. When the control rod 48 has almost reached its rightmost position, that is a position corresponding to the highest permissible amount of fuel being delivered to the internal combustion engine 10, the linkage 47 closes the switch 46, the electric circuit 45 is completed, the coil 43 is energized so that the arresting member 42 moves into arresting contact with the valve member 37 and arrests the same in the momentarily assumed position. From now on, until the coil 43 is de-energized, the throttle valve 35 acts as a fixed flow-through cross-sectional area valve.

Now, so long as the speed of rotation of the shaft 10' remains the same, the pressure in the discharge conduit 33 also remains the same. However, inasmuch as the control slide 30 is in its position I, the piston 26 will be supplied with pressurized medium, so that the adjusting elements 21 and 22 will be moved toward still higher outputs of the variable-output pumps 11 and 12. This will result in an increasing power demand on the drive 10 and, consequently, in a reduction of speed of rotation of the output shaft 10'. This, in turn, results in a reduction of the speed of rotation of the auxiliary pump 13 and thus in the reduction of the discharge rate thereof. Since the throttle valve 35 has a fixed flow-through cross-sectional area, the reduction in the discharge rate of the auxiliary pump 13 will result in a quadratically proportionate reduction in the pressure in the discharge conduit 33 and thus also in the conduit 34. Eventually, the pressure in the conduit 34, that is the pressure which results in a force acting on the slide 30 holding the same in the position I, is reduced to such an extent that the spring 30' displaces the control slide 30 toward its position II. When this happens, communication is established between the conduit 31 and the conduit 32 so that the pressure on the piston 26 is relieved and at least a part of the fluid in the conduit 31 flows through the conduit 32 into the receptacle 15. On the other hand, the piston 25 is still supplied with the pressurized fluid in the conduit 28, via the conduit 27 so that the adjusting elements 21 and 22 of the pumps 11 and 12 are displaced toward their positions in which the output of the pumps 11 and 12 is reduced. The reduced output of the variable-output pumps 11 and 12, in turn, results in a reduced power demand on the drive 10, so that the control bar 48 of the injection-control arrangement 49 moves against the arrow, that is leftwardly, so that the linkage 47 opens the switch 46. Once the switch 46 is opened, the coil 43 is de-energized and the arresting member 42 releases the valve member 37 so that the latter can assume its position which corresponds to the instantaneous pressure prevailing in the discharge conduit 33. As a result of the reduction in the output rate of the variable-output pumps 11 and 12, the rotational speed of the drive 10 and thus of the output shaft 10' again increases, so that the discharge rate of the auxiliary pump 13 also increases, resulting in an increase in the pressure in the conduit 33 and the conduit 34, so that the control slide 30 is again displaced into its position I. Thus, the connection of the conduit 28 with the conduit 31, and thus with the piston 26, is re-established, and the variable-output pumps 11 and 12 are again adjusted by the adjusting elements 21 and 22 toward their high-output positions. This results in an increase of the load on the drive 10 and, when the load on the drive 10 again approaches the full-load condition thereof, the above-discussed operating cycle is repeated.

From what has been said above, it may be seen that the control arrangement serves the purpose of operating the drive 10, such as a diesel engine, in such a range of speeds in which the drive 10 operates under the most advantageous and economical conditions so that the available power output of the drive 10 can be utilized to the greatest possible extent.

The throttle valve 35 may advantageously be a pressure-limiting valve with a valve body which controls the flow-through cross-sectional area of the throttle valve 35, the throttle valve 35 being adjusted to a pressure which has a value slightly above that value at which the control slide 30 moves between the position I and II. It is to be understood that the electromagnetic actuation of the arresting member 42 is exemplary only, and that a mechanical, manual or pressure-fluid-caused displacement of the arresting member 42 can be used instead.

It will also be appreciated that while the present invention has been discussed as using the same fluid for all circuits, the pumps 11, 12 and 13 may each pump a different fluid, if such is desired.

Figure 2:
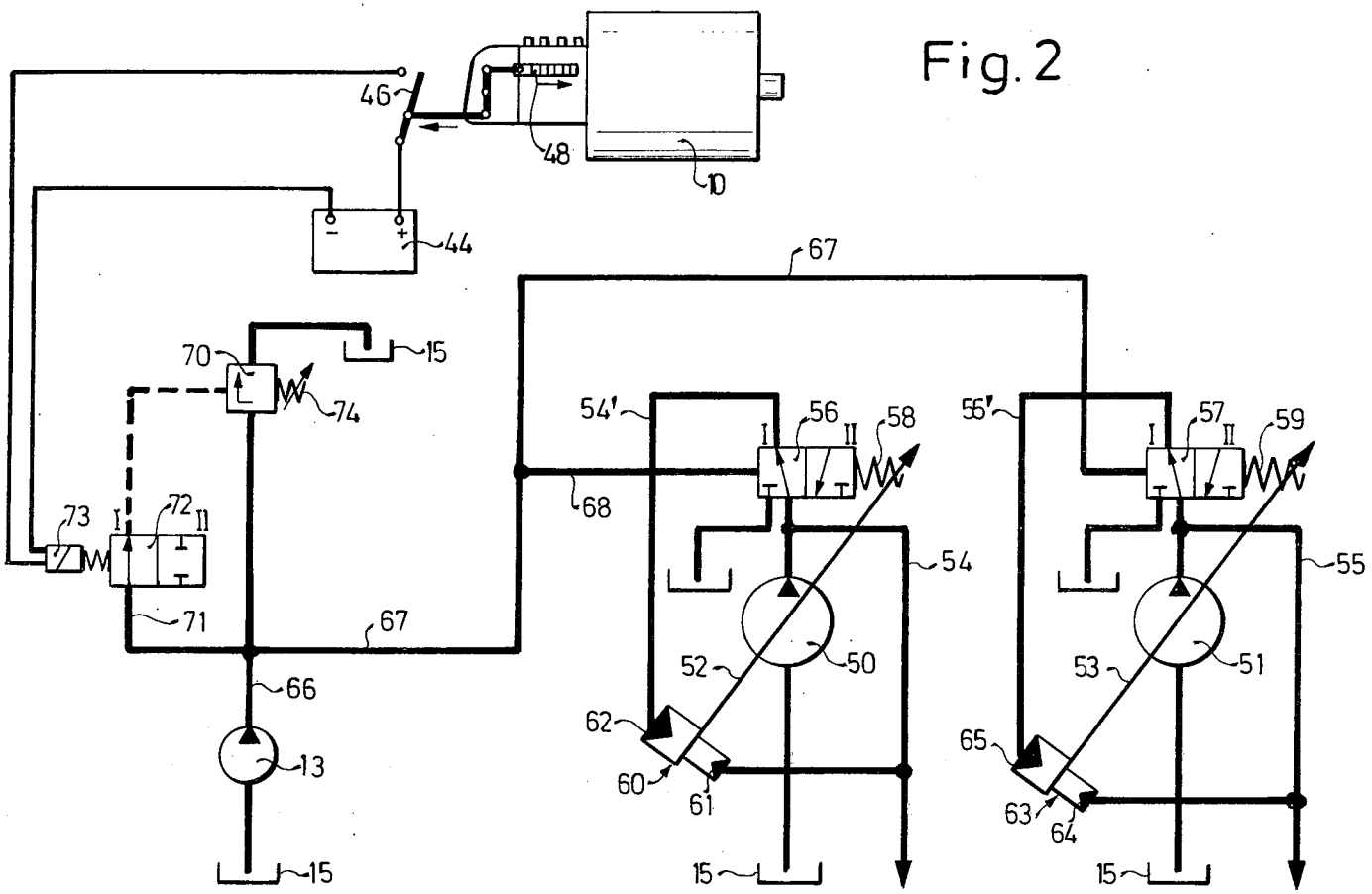
FIG. 2 is a view similar to FIG. 1 but illustrating a different embodiment of the present invention.

The embodiment illustrated in FIG. 2 differs from the embodiment of FIG. 1 mainly in the fact that the adjusting elements 52 and 53 of the pumps 50 and 51 are not mechanically coupled with one another. In other respects, the variable-output pumps 50 and 51 are similar to the previously described pumps 11 and 12, so that the operation thereof need not be discussed in detail.

The pump 50 pumps fluid into a first user circuit 54, and the pump 51 pumps fluid into a second user circuit 55. A control slide 45 is in communication with the circuit 54, and a control slide 57 is in communication with the circuit 55. These two control slides 56 and 57 are of the same constructions. Control fluid from the pump 13 is delivered, via conduits 67, 68, to the control slides 56 and 57, respectively, and acts thereon against the force exerted by springs 58 and 50, respectively. The control slides 56 and 57 are constructed similarly, and function in the same way, as the control slide 30 discussed above.

A power amplifier 60 acts on the adjusting element 52, and includes a piston 61 of a smaller active area, and a piston 62 of a larger active area. The piston 61 is permanently supplied with pressurized fluid from the circuit 54, while the conduit 54' supplies pressurized fluid to the piston 62 only when the control slide 56 is in its position I. The stress of the spring 58 can be dependent on the position of the adjusting element 52, in a conventional manner. Similarly, a power amplifier 63 is associated with the pump 51, and has a piston 64 of a smaller active area, and a piston 65 of a larger active area. Pressurized fluid from the circuit 55 is permanently supplied to the piston 54, and also to the piston 55, but only when the control slide 57 is in the position I, through the conduit 55'. The stress of the spring 59 can again be dependent on the position of the adjusting element 53 as already known from prior art.

The auxiliary pump 13 discharges control fluid into the conduit 66 which communicates, in addition to the conduit 67, with a throttle valve 70 which acts as a pressure-limiting valve. Furthermore, the discharge conduit 66 communicates with conduit 71 which leads to a magnetically actuated valve 72 and, when the latter is in its position I, the control fluid is admitted to the throttle valve 70 to act on the same against the force of a spring 74. The magnetically actuated valve 72 can be moved into a position II in which communication between the conduit 71 and the throttle valve 70 is interrupted. The valve 72 is displaced between its position I and II by an electromagnet 73 which, similarly to what has been discussed above in connection with FIG. 1, is arranged in an electric circuit including a battery 44 and a switch 46 which is moved by the control bar 48 of the drive 10 in such a manner that the switch 46 is closed and the electromagnet 73 energized when the drive 10 approaches its full load condition.

The throttle valve 70 is supplied with a pressurized control fluid from the auxiliary pump 13 through the conduit 71 and the valve 72 which is in its flow-through position I. The response of the throttle valve 70 to the pressure of the fluid is the same as that discussed previously in connection with the throttle valve 35. As the drive 10 approaches its full load condition, that is as the control bar 48 is moved in the direction of the arrow, eventually the switch 46 is closed, an electric circuit established, and the electromagnet 73 moves the valve 72 into its interrupted position II. Thus, the pressurized fluid is unable to escape from the throttle valve 70, and the spring 74 holds the valve 70 in its instantaneous position, the enclosed volume of the fluid preventing displacement of the valve 70 due to the action of spring 74. This changes the proportionality characteristic of the throttle valve 70. Namely, as long as the control fluid pressure follows the variation of the discharge rate of the auxiliary pump 13, the throttle valve 70 has a substantially equal-pressure characteristic. However, once the throttle valve 70 is arrested, the pressure in the discharge conduit 66, and thus the pressure acting on the control slides 56 and 57 through the conduits 67 and 68 varies substantially in a quadratic proportion to the discharge rate of the auxiliary pump 13 and thus to the speed of rotation thereof and of the drive 10. Once the speed of rotation of the drive 10 decreases a certain amount below the speed of rotation at which the throttle valve 70 is arrested, the control slides 56 and 57 are displaced by the springs 58 and 59 into their respective positions II so that, similarly to what has been described above in connection with FIG. 1, the variable-output pumps 50 and 51 are adjusted to lower outputs. In all other respects the operation of the arrangement of FIG. 2 is similar to that discussed in connection with FIG. 1, so that further elaboration is not deemed necessary.

Figure 3:
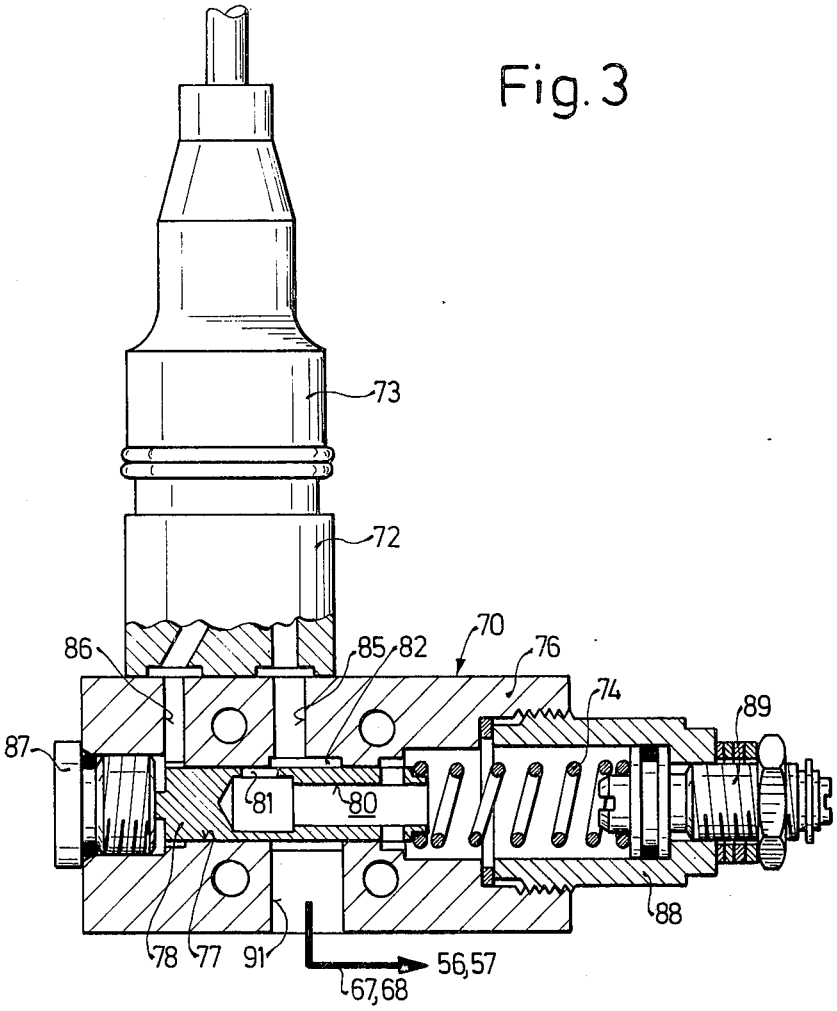
FIG. 3 is a longitudinal sectional view of a control slide which may be used in the embodiments illustrated in FIGS. 1 and 2.
Figure 3A:
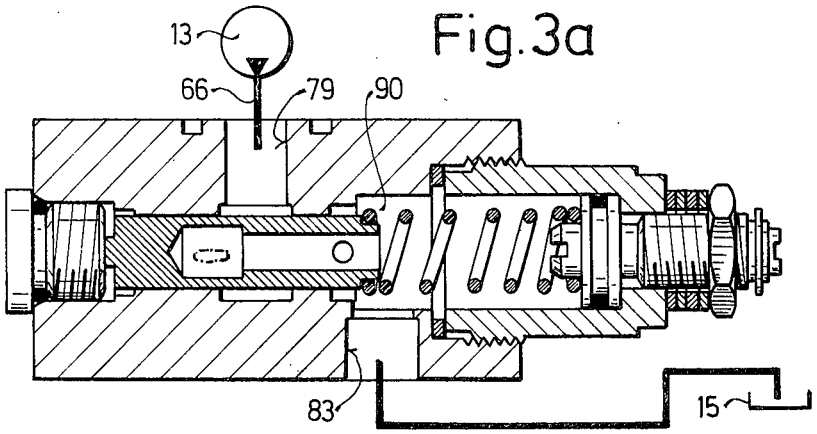
FIG. 3*a* is a longitudinal cross-sectional view of the valve of FIG. 3 taken on a plane substantially normal to the plane of FIG. 3.

FIGS. 3 and 3*a* illustrate an exemplary embodiment of a valve unit which combines the throttle valve 70 with the magnetically actuated valve 72 and 73. The housing of the valve 70 is designated with the reference numeral 76, and is formed with a through longitudinal bore 77 in which a valve member 78 is mounted for reciprocation. A spring 74 acts on the valve member 78.

As seen in FIG. 3*a*, the housing 76 is formed with a transverse bore 79 which communicates with the longitudinal bore 77, and the conduit 66 from the auxiliary pump 13 communicates with the transverse bore 79. The valve member 78 has a channel 80, and a slot 81 communicates the channel 80 with the exterior of the valve member 78. The housing is further formed with an annular recess 82 in the region of the slot 81. The annular recess 82 communicates with the transverse bore 79. The housing 70 further has a chamber 90, and a further transverse bore 83 communicates with the chamber 90 and with the receptacle 15. It may be seen that the transverse bore 79, in cooperation with the annular recess 82 and the slot 81 establishes a throttling connection between the auxiliary pump 13 and the discharge conduit 66 thereof, and the receptacle 15. An additional transverse bore 91 communicates the annular recess 82 with the conduit 67, 68 leading to the control slides 56 and 57.

Still another transverse bore 85 communicates with the annular recess 82, such bore 85 communicating with the magnetically operated valve 72. A further transverse bore 86 communicates with the left end of the bore 77, such bore 86 also communicating with the magnetically operated valve 72. The magnetically operated valve 72 is capable of establishing and interrupting supply of pressurized fluid into the left-hand region of the bore 77 and discharge of fluid therefrom such fluid acting upon the valve member 78 against the action of the spring 74. Thus, so long as the communication through the bore 86 is established, the pressurized fluid displaces the valve member 78 against the force of the spring 74 in dependence of the variation of the pressure of the fluid passing through the magnetically operated valve 72. On the other hand, when the magnetically operated valve 72 interrupts such communication, the fluid acting on the valve member 78 from the side of the bore 86 is prevented from escaping so that the valve member 78 is arrested, by the combined action of the fluid and of the springs, in the instantaneous position thereof. Thus, the valve 70 operates in the manner discussed above in connection with FIG. 2.

The housing 76 is further equipped with threaded-in plugs 87 and 88 which close the longitudinal bore 77. The plug 88 supports a screw 89 by means of which the tension of the spring 74 can be adjusted.

Figure 4:
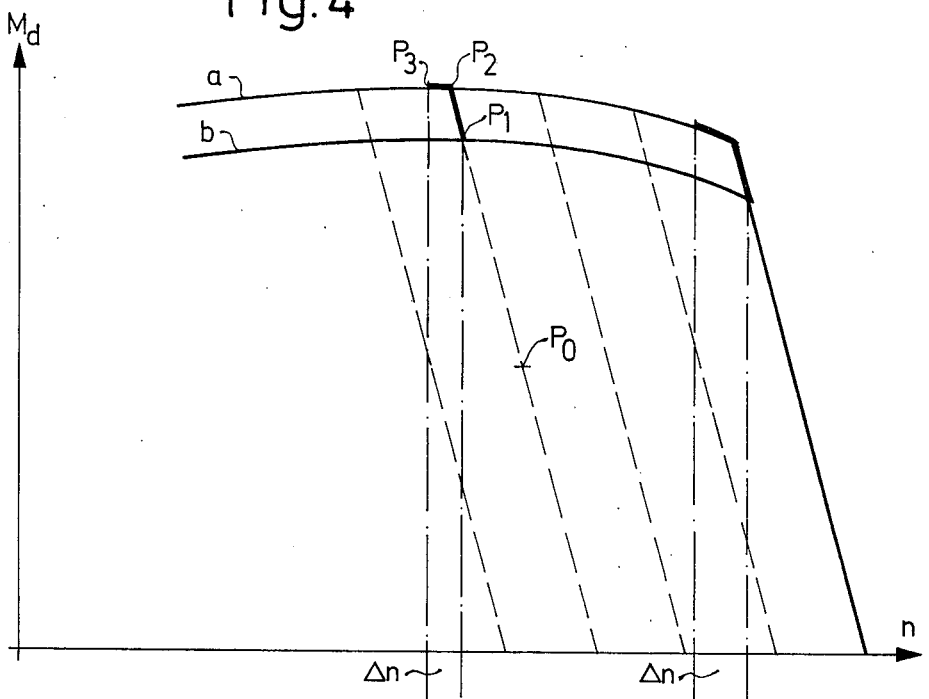
FIG. 4 is a graphic representation of the relation between the torque delivered by, and the speed of the drive.

FIG. 4 is a diagrammatic presentation of the dependence of the torque $M_d$ on the speed of rotation $n$ of the diesel engine. The curve $a$ represents the maximum torque which can be delivered by the internal combustion engine, such as the diesel engine. The switch 46 illustrated in FIGS. 1 and 2 is closed before the torque reaches the value corresponding to the curve $a$, and the torque at which the switch 46 is closed is represented by the curve $b$ in FIG. 4.

Figure 5:
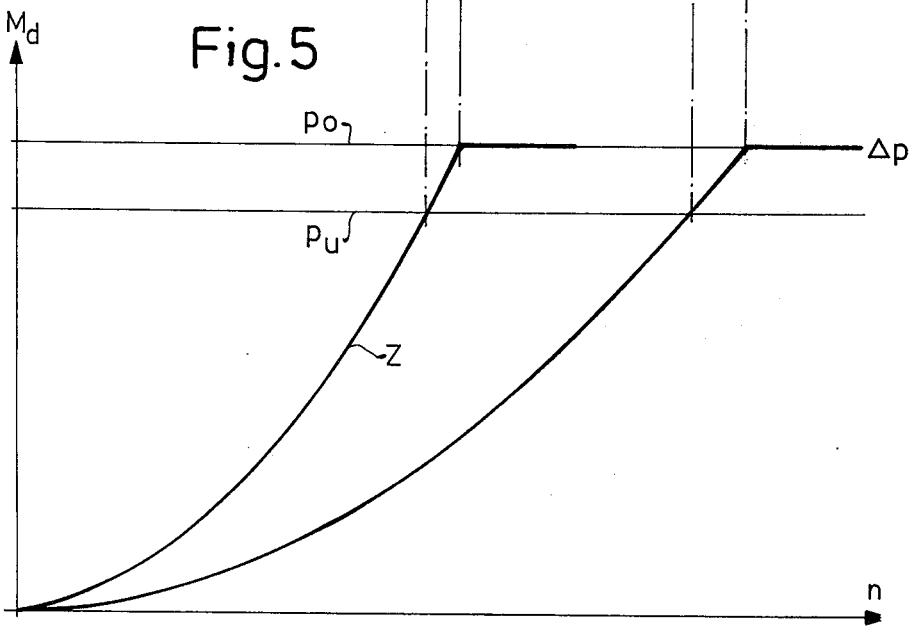
FIG. 5 is a graphic representation of the relation between the power consumption of the variable-input pump on the speed of rotation thereof.

FIG. 5 is a diagrammatic representation of the dependence of the pressure of the medium discharged by the auxiliary pump 13 on the speed of rotation of the output shaft of the internal combustion engine 10. Since such pressure, as explained above, is dependent on the speed of rotation $n$ and on the position of the throttle valve 70 or 37 and is indicative of the torque delivered by the internal combustion engine 10, the scale of the ordinate may be expressed in terms of the torque $M_d$ of the internal combustion engine 10. The graphic representation of FIG. 5 shows two exemplary curves representative of the dependence of the torque on the number of rotations, one of these curves corresponding to a medium range of speeds, the other curve corresponding to the maximum range of speeds. The upper horizontal line which is designated with $p_o$ corresponds to the selected pressure of the throttle valve 70. The horizontal line designated with $p_u$, which is spaced from the line $p_o$ by a distance $\Delta p$ is representative of the pressure at which the control slides 56 and 57 of FIG. 2, or the control slide 30 of FIG. 1, are displaced from the position I into position II. Referring back to FIG. 4, the inclined lines illustrated therein are examples of the arbitrarily selectable control lines of the diesel engine 10.

The cooperation of the drive with the variable-output pumps driven thereby will now be explained by way of an example with reference to FIGS. 4 and 5. Beginning with a situation in which the variable-output pumps require so much power from the drive as corresponds to the point $P_o$ of FIG. 4, the adjusting elements of the variable-output pumps will adjust the latter toward higher outputs so that the load on the drive will increase, with concomitant reduction in the speed of rotation, along the dashed line on which the point $P_o$ is located toward the points $P_1$ and $P_2$. When the drive is loaded to an extent corresponding to the point $P_1$, the switch 46 is closed by the action of the control bar of the injection-control arrangement, so that the valve member of the throttle valve is electromagnetically arrested in its instantaneous position. However, the variable-output pumps are still being adjusted in direction toward higher outputs, so that the speed of rotation of the drive, and thus of the auxiliary pump, is further reduced. This, in turn, results in a substantially quadratic decrease of the pressure of the control fluid discharged by the auxiliary pump along the curve $z$ of FIG. 5. Simultaneously therewith, the load of the drive increases from the point $P_1$ to the point $P_2$, and then along the full load curve $a$ from the point $P_2$ to the point $P_3$, as seen in FIG. 4. When the load of the drive is at the point $P_3$, the number of rotations of the drive has been reduced by $\Delta n$, and the pressure of the control fluid has been reduced by $\Delta p$ to $p_u$. At this pressure, the control slide 30 of FIG. 1 or the control slides 56 and 57 of FIG. 2 are displaced by their respective springs from the positions I to the positions II. This, in turn, results in displacement of the adjusting elements of the pumps in direction toward lower outputs, so that the power demand on the drive is reduced and further reduction in the speed of rotation of the drive is prevented. The reduced power demand on the drive 10 eventually results in opening of the switch 46 and the entire control process repeats itself. Thus, the entire pumping arrangement has the tendency to operate within the range of advantageous operating conditions of the drive, that is as close to the full-load curve *a* as possible without overloading the drive.

It will be understood that each of the elements described above, or two or more together, may also find a useful application in other types of constructions differing from the types described above. So, for instance, while the present invention has been described as using two variable-output pumps, it will be understood that the concept of the present invention can be utilized to advantage in connection with a lesser or a higher number of the variable-output pumps.

While the invention has been illustrated and described as embodied in a fluid-pumping arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an arrangement for pumping fluids, a combination comprising pumping means for pumping a fluid at a variable output rate, including at least one variable-output pump having an adjusting element adapted to control the output rate of said pump; adjusting means for adjusting the output rate of said pumping means, including displacing means for displacing said adjusting element between low-output and high-output positions thereof; driving means for driving said pumping means at varying speeds; first generating means for generating a first signal indicative of power input to said driving means; second generating means for generating a second signal proportionate to the speed of said driving means, including an auxiliary pump driven by said driving means and operative for discharging control fluid at a rate proportionate to the speed of said driving means, a discharge conduit communicating with said auxiliary pump, and a throttle valve in said discharge conduit having a valve housing and a valve member mounted in said valve housing for displacement between an extended and a retracted position through a plurality of intermediate positions in which said throttle valve has different flow-through cross-sectional areas for passage of the control fluid therethrough, biasing means urging said valve member toward said extended position thereof, and means for admitting the control fluid in said discharge conduit upstream of said throttle valve to the latter to act on said valve member against the action of said biasing means; and control means for controlling said adjusting means in dependence on said first and second signals, including arresting means for arresting said valve member in any of said positions thereof when said first signal reaches a predetermined value to thereby change the proportionality characteristic of said second generating means by maintaining the respective flow-through cross-sectional area of said throttle valve, and a control slide displaceable between a first position in which said displacing means displaces said adjusting element toward said low-output position and a second position in which said displacing means displaces said adjusting element toward said high-output position, said control slide being responsive to changes in said second signal.

2. A combination as defined in claim 1, wherein said arresting means includes a control valve interposed between said discharge conduit upstream of said throttle valve and said admitting means and operative for establishing and interrupting communication between the former and the latter so that said valve member is arrested in the instantaneous position thereof when said control valve interrupts the communication.

3. A combination as defined in claim 1, wherein said driving means includes an internal combustion engine with fuel injection having an injection-control arrangement; and wherein said first generating means is responsive to an operating condition of said injection-control arrangement for generating said first signal when the fuel consumption of said engine approaches a maximum permissible value.

4. A combination as defined in claim 1, wherein said control means includes electromagnetic means operative for arresting said valve member in an instantaneous position thereof to thereby fix the flow-through corss-section thereof in response to said first signal, said electromagnetic means including a casing directly connected to said valve housing.

5. A combination as defined in claim 1, wherein said arresting means includes an arresting member movable into and out of arresting contact with said valve member, and moving means for moving said arresting member.

6. A combination as defined in claim 5, wherein said moving means includes at least one electromagnet.

7. A combination as defined in claim 5, wherein said moving means includes a mechanical force-transmitting arrangement.

8. A combination as defined in claim 5, wherein said moving means includes at least one fluid-operated cylinder-and-piston unit.

9. A combination as defined in claim 1, and wherein said arresting means includes a control valve interposed between said source and said admitting means and operative for establishing communication between the former and the latter when in an open position, and for interrupting the communication when in a closed position, and switching means for switching said control valve between said open and closed positions thereof.

10. A combination as defined in claim 9, wherein said switching means includes an electromagnet energizable for switching said control valve between said positions in response to said first signal.

11. A combination as defined in claim 1, wherein said driving means includes an electromotor; and wherein said first generating means is responsive to an operating condition of said electromotor for generating said first signal when the power input of said electromotor approaches a maximum permissible value.

12. A combination as defined in claim 11, wherein said operating condition is the current supplied to the electromotor.

13. A combination as defined in claim 11, wherein said operating condition is the electric power supplied to said electromotor.

14. In an arrangement for pumping fluids, a combination comprising pumping means for pumping a fluid at a variable output rate, including at last one variable-output pump having an adjusting element adapted to control the output rate of said pump; adjusting means for adjusting the output rate of said pumping means, including displacing means for displacing said adjusting element between low-output and high-output positions thereof; driving means for driving said pumping means at varying speeds; first generating means for generating a first signal indicative of power input to said driving means; second generating means for generating a second signal proportionate to the speed of said driving means, including an auxiliary pump which discharges control fluid; and control means for controlling said adjusting means in dependence on said first and second signals, including varying means for changing the proportionality characteristic of said second generating means when said first signal reaches a predetermined value, a control slide displaceable between a first position in which said displacing means displaces said adjusting element toward said low-output position and a second position in which said displacing means displaces said adjusting element toward said high-output position, said control slide being responsive to changes in said second signal, and a conduit connecting said auxiliary pump with said control slide for displacing the latter between said first and second positions thereof in dependence on the pressure of said control fluid.

15. A combination as defined in claim 14, said pumping means further including at least one additional variable-output pump similar to said variable-output pump; and wherein said adjusting means includes connecting means for connecting said adjusting elements of said variable-output pumps with one another so as to simultaneously displace the same between said low-output and high-output positions thereof.

16. A combination as defined in claim 14, wherein said displacing means includes a cylinder-and-piston arrangement, said conduit means for selectively admitting fluid to said arrangement; and wherein said control slide is interposed in said conduit means and is operative for controlling admission of the fluid to said arrangement.

17. A combination as defined in claim 16, said pumping means further including at least one additional variable-output pump similar to said variable-output pump; wherein said control means further includes an additional control slide similar to said control slide and an additional conduit connecting said auxiliary pump with said additional control slide for displacing the latter between said first and second positions thereof simultaneously with displacement of said control slide between said positions, and an additional cylinder-and-piston arrangement controlled by said additional arrangement and acting on the adjusting element on said additional pump.

18. In an arrangement for pumping fluids, a combination comprising pumping means for pumping a fluid at a variable output rate; adjusting means for adjusting the output rate of said pumping means; driving means for driving said pumping means at varying speeds; first generating means for generating a first signal when power input to said driving means approaches a maximum permissible value thereof; second generating means for generating a second signal proportionate to the speed of said driving means including a valve member displaceable between a plurality of positions; and control means for controlling said adjusting means in dependence on said first and second signals, including varying means for changing the proportionality characteristic of said second generating means when said first signal reaches a predetermined value, including an arresting member movable into and out of arresting contact with said valve member, and an electromagnet energizable for moving said arresting member into arresting contact with said valve member in response to said first signal.

19. In an arrangement for pumping fluids, a combination comprising pumping means for pumping a fluid at a variable output rate; adjusting means for adjusting the output rate of said pumping means; driving means for driving said pumping means at varying speeds, including an internal combustion engine with fuel injection having an injection-control arrangement; first generating means for generating a first signal indicative of power input to said driving means and responsive to an operating condition of said injection-control arrangement for generating said first signal when the fuel consumption of said engine approaches a maximum permissible value and including a source of electric current, an electromagnet, a circuit connecting said electric source with said electromagnet, a switch interposed in said circuit, and an actuating member connecting said injection-control arrangement with said switch and operative for closing the latter when the fuel consumption of said engine approaches said maximum permissible value to thereby energize said electromagnet; second generating means for generating a second signal proportionate to the speed of said driving means; and control means for controlling said adjusting means in dependence of said first and second signals, including varying means for changing the proportionality characteristic of said second generating means when said first signal reaches a predetermined value.

20. In an arrangement for pumping fluids, a combination comprising at least one variable-output pump; an auxiliary pump operative for discharging control fluid proportionately to the speed thereof; driving means for driving said pump and said auxiliary pump at commensurately varying speeds; a discharge conduit communicating with said auxiliary pump; adjusting means for adjusting the output of said pump upwardly when the pressure in said discharge conduit is above, and downwardly when said pressure is below, a predetermined value; and means for controlling the pressure in said discharge conduit in dependence on the power input to said driving means, including a throttle valve having a valve housing, a valve member mounted in said valve housing for movement and acted upon by the control fluid in said discharge conduit in one direction, and biasing means urging said valve member opposite to said direction, said controlling means further including arresting means for arresting said valve member in any respective position thereof when the power input to said driving means reaches a predetermined magnitude, said throttle valve having a flow-through cross-sectional area which gradually increases as said valve member moves in said one direction so that the pressure in said discharge conduit remains above said predetermined value when said arresting means is inactive while dropping below said value when said arresting means arrests said valve member and the speed of said auxiliary pump decreases as a result of overloading of said driving means.

* * * * *